US007125269B2

(12) United States Patent
Ohta et al.

(10) Patent No.: US 7,125,269 B2
(45) Date of Patent: Oct. 24, 2006

(54) CONNECTOR PROVIDED WITH COVER

(75) Inventors: Yoshinori Ohta, Tokyo (JP); Takeshi Konno, Tokyo (JP); Shingo Naito, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/880,084

(22) Filed: Jun. 30, 2004

(65) Prior Publication Data

US 2004/0266264 A1 Dec. 30, 2004

(30) Foreign Application Priority Data

Jun. 30, 2003 (JP) ..... P2003-188061

(51) Int. Cl.
*H01R 13/44* (2006.01)

(52) U.S. Cl. ..... 439/140; 439/608

(58) Field of Classification Search ..... 439/108, 439/139–140, 607–608
See application file for complete search history.

(56) References Cited

U.S. PATENT DOCUMENTS 4,959,021 A * 9/1990 Byrne ..... 439/310
5,108,297 A * 4/1992 Hoffman et al. ..... 439/134
5,167,516 A * 12/1992 Tan et al. ..... 439/141
5,197,887 A * 3/1993 Davidge et al. ..... 439/60
5,408,384 A * 4/1995 Gannyo et al. ..... 361/737
5,769,646 A * 6/1998 Cavello et al. ..... 439/136
6,305,953 B1 * 10/2001 Shi et al. ..... 439/108
6,305,955 B1 * 10/2001 Billman ..... 439/138
6,604,964 B1 * 8/2003 Hoshino et al. ..... 439/607
6,733,311 B1 * 5/2004 Kameda ..... 439/140

FOREIGN PATENT DOCUMENTS

JP 2002-117931 4/2002

* cited by examiner

*Primary Examiner*—Truc Nguyen
(74) *Attorney, Agent, or Firm*—Whitham, Curtis, Christofferson & Cook, PC

(57) ABSTRACT

An insulative connector body is accommodated in a conductive shield case. A conductive contact is provided on the connector body. An insulative cover is accommodated in the shield case so as to be slidable between a first position for concealing the contact and a second position for exposing a part of the contact and allowing a mating connector to electrically contact therewith. A conductive shield member is attached onto a front face of the cover which faces the mating connector.

6 Claims, 4 Drawing Sheets

CONNECTOR PROVIDED WITH COVER

BACKGROUND OF THE INVENTION

This invention relates to a connector provided with a cover. More particularly, the invention relates to a connector in which contacts provided in a central portion of a connector body is shielded by a cover, and the shielding of the contacts by the cover is canceled in accordance with a connecting operation of the connector with respect to a mating plug, so that the contacts are prevented from electrostatic damage.

Various connectors of this kind are already known, and for example, Japanese Patent Publication No. 2002-117931A (cf., pages 1 to 7, and FIGS. 1 through 6) discloses a connector provided with a shutter which is opened in accordance with an operation of connection of a connector body (socket) to a mating plug. This connector is provided with a lock cover which locks the shutter against sliding movement to an open position when the shutter is closed. In accordance with the operation of connection of the socket to the mating plug, this lock cover cancels this locked condition of the shutter.

In this connector, the shutter prevents a conducting member from coming into contact with contacts of the socket, and also prevents dirt from entering the socket, thereby preventing an accident such as short-circuiting and incomplete contact.

In this connector, however, there is a probability that static electricity developed upon contact of the mating plug or other object with the shutter, so that the contacts and others were subjected to electrostatic damage.

SUMMARY OF THE INVENTION

It is therefore an object of the invention to provide a connector provided with a cover which is capable of eliminates the above electrostatic damage.

In order to achieve the above object, according to the invention, there is provided a connector, comprising:

a conductive shield case;

an insulative connector body, accommodated in the shield case;

a conductive contact, provided on the connector body;

an insulative cover, accommodated in the shield case so as to be slidable between a first position for concealing the contact and a second position for exposing a part of the contact and allowing a mating connector to electrically contact therewith; and a conductive shield member, attached onto a front face of the cover which faces the mating connector.

With the above configuration, electrostatic damage of the contact is prevented by the shield member.

Preferably, the cover comprises a first engagement member, and the shield member comprises a second engagement member engaged with the first engagement member.

In this case, the shield member can be easily and securely attached to the cover by the engagement members.

Preferably, the shield member comprises a conductive piece which is always brought into contact with the shield case.

In this case, static electricity, developing in the shield member, is caused to escape to the shield case.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One preferred embodiment of the present invention will be described below in detail with reference to the accompanying drawings.

Figure 1A:
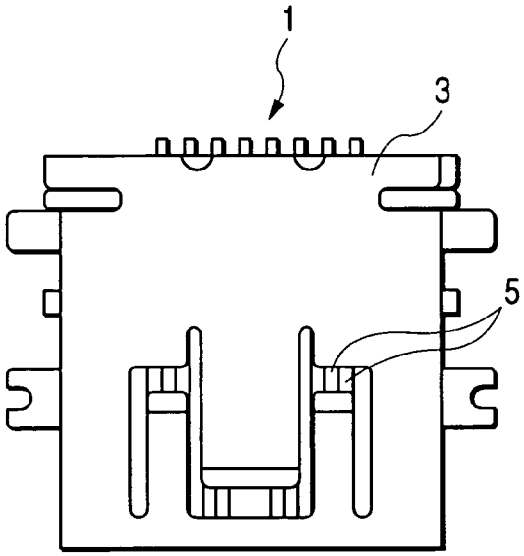
FIG. 1A is a plan view of a connector according to one embodiment of the present invention.
Figure 1B:
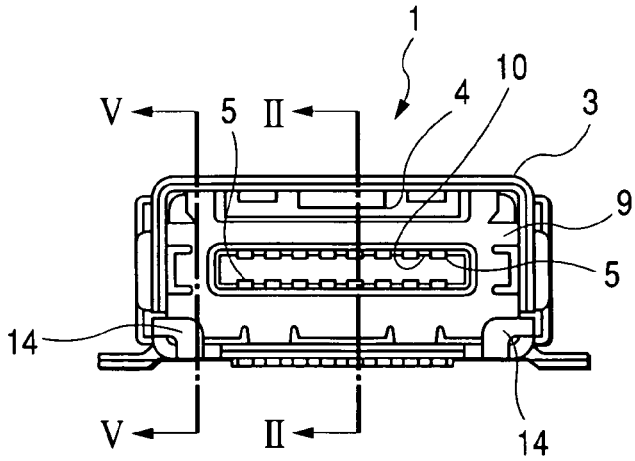
FIG. 1B is a front view of the connector.
Figure 1C:
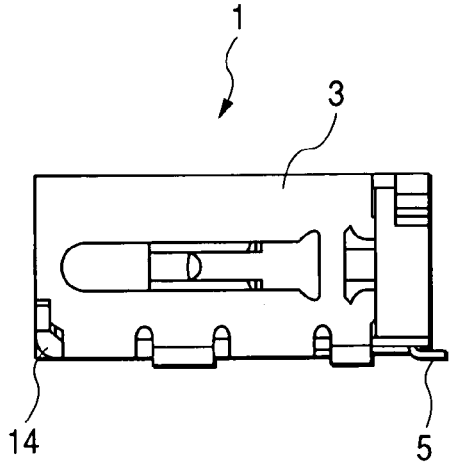
FIG. 1C is a side view of the connector.
Figure 2:
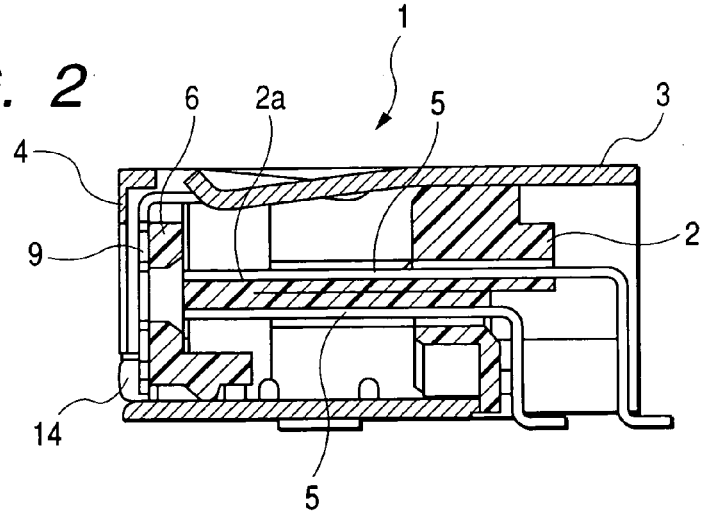
FIG. 2 is a section view taken along a line II—II of FIG. 1B.

A connector 1 is used for charging a device such as a magneto-optic storage device or a video camera. The connector 1 includes a connector body 2 having a projecting portion 2*a* formed at a central portion of a front side (left side in FIG. 2) thereof. As shown in FIGS. 1A to 1C, an outer face of the connector body 2 is covered with a shield case 3 which is in the form of a square tubular assembly. As shown in FIG. 2, the shield case 3 extends forwardly beyond a front face the connector body 2 so as to define a fitting hole 4. Contacts 5 are arrayed upper and lower faces of the projecting portion 2*a* of the connector body 2, so that these contacts 5 are disposed at a central portion of the fitting hole 4 as shown in FIG. 1B.

A cover 6 for shielding or covering the contacts 5 at the front side thereof is slidably provided in the fitting hole 4. This cover 6 is so constructed as to slide rearward in accordance with an operation of connection of the connector 1 to a mating plug (not shown) so that the shielding of the contacts 5 can be canceled.

Figure 3A:
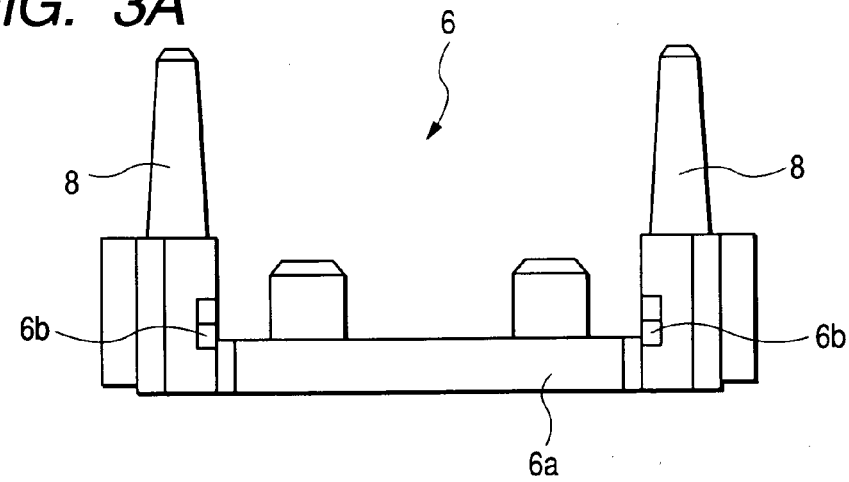
FIG. 3A is a plan view of a cover shown in FIG. 2.
Figure 3B:
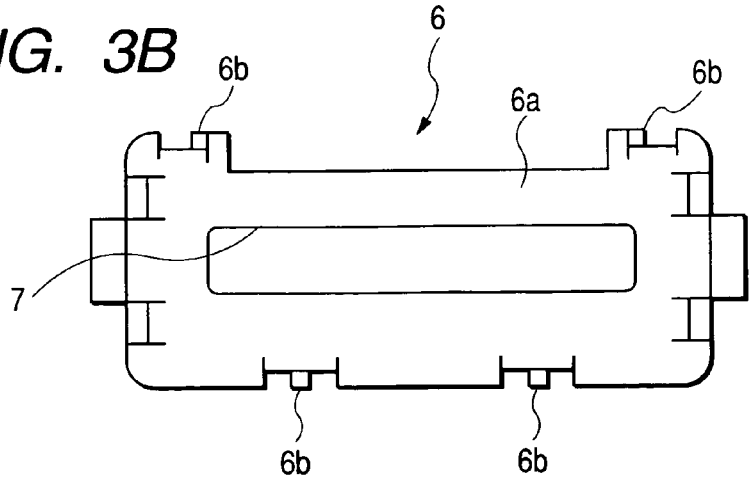
FIG. 3B is a front view of the cover.

As shown in FIGS. 3A and 3B, the cover 6 includes a plate-shaped body portion 6*a*, and a through hole 7 is formed through a central portion of this body portion 6*a*. Front portions of the contacts 5 are allowed to pass through this through hole 7 to be exposed. Spring supporters 8 are formed on and project from right and left end portions of a rear face of the body portion 6*a*, respectively. Projections 6*b* are formed respectively on right and left end portions of upper and lower sides of the cover 6.

Figure 4A:
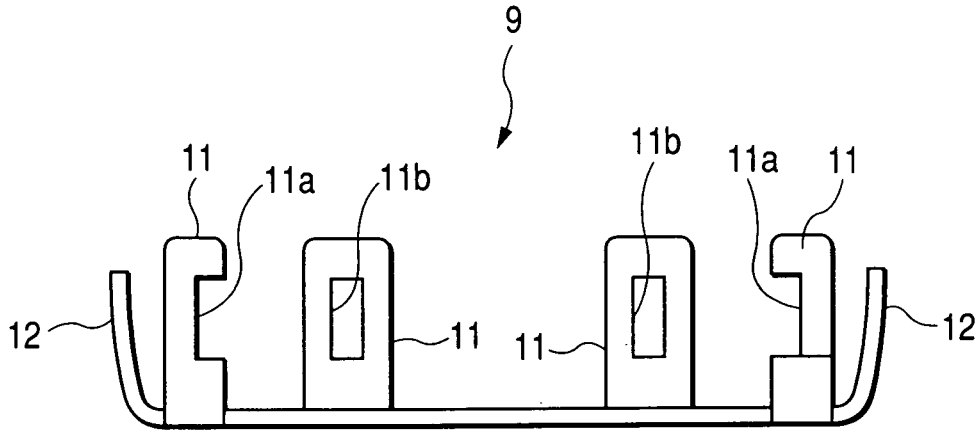
FIG. 4A is a plan view of a metal shield shown in FIG. 1.
Figure 4B:
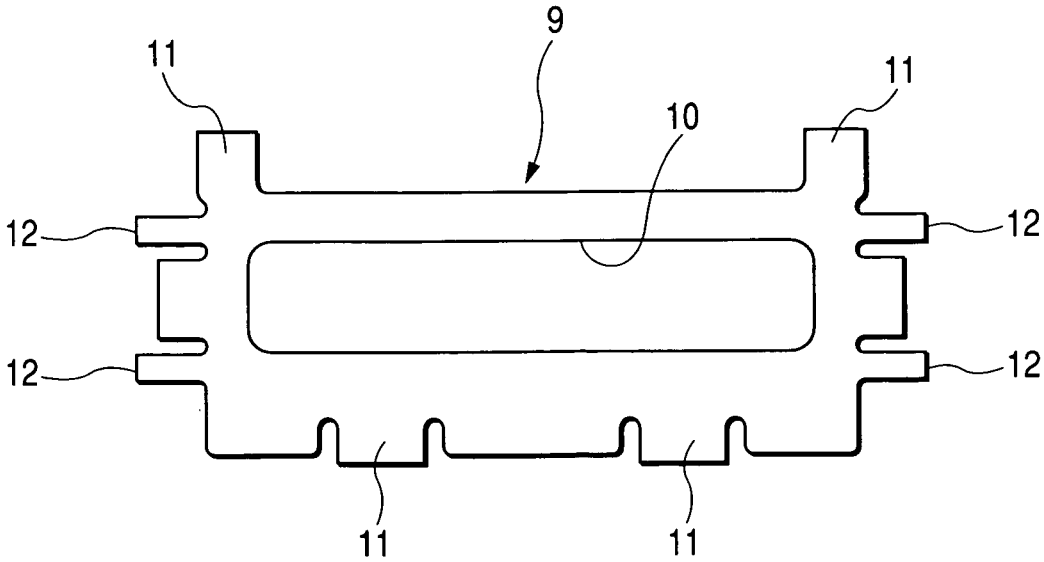
FIG. 4B is a front view of the metal shield.

A metal shield 9, shown in FIGS. 4A and 4B, is attached to the front face of the cover 6. A through hole 10 which is slightly larger in size than the through hole 7 in the cover 6 is formed through the metal shield 9, and engagement ribs 11 for attaching the metal shield 9 to the cover 6 are formed on upper and lower edges of the metal shield 9, so as to extend rearward. Contact pieces 12 are formed on right and left side edges of the metal shield 9 so as to extend rearward in an obliquely spreading manner. The contact pieces 12 are configured so as to be always brought into contact with the shield case 3.

Each of the engagement ribs 11 on the upper edge of the metal shield 9 is formed with an engagement recess 11*a* which is to be engaged with one of the projections 6*b* formed on the right and left end portions of the upper side of the cover 6. On the other hand, each of the engagement ribs 11 on the lower edge of the metal shield 9 is formed with a through hole 11*b* to be engaged with one of the projections 6*b* formed on the right and left end portions of the lower side of the cover 6. By elastically deforming the engagement ribs 11, the engagement recesses 11*a* are engaged respectively with the corresponding projections 6*b*, while the engagement holes 11*b* are engaged respectively with the corresponding projections 6*b*, so that the metal shield 9 is attached to the cover 6.

According to the provision of the engagement ribs 11, the metal shield 9 can be easily and securely attached to the cover 6.

Figure 5:
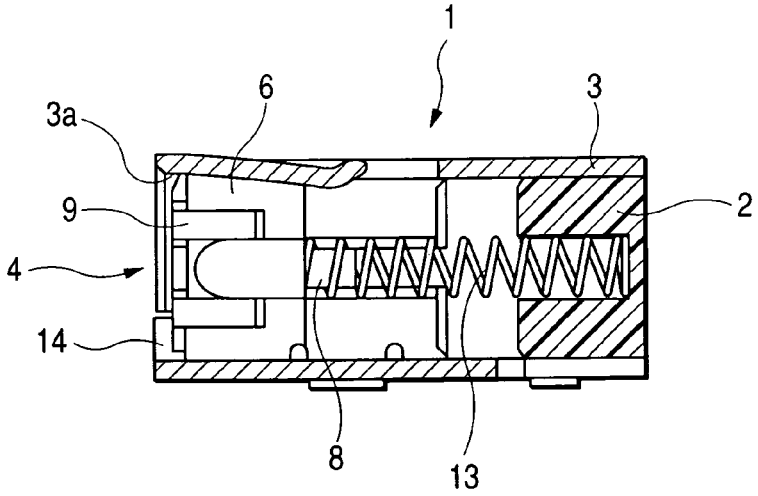
FIG. 5 is a section view taken along a line V—V of FIG. 1B.
Figure 6A:
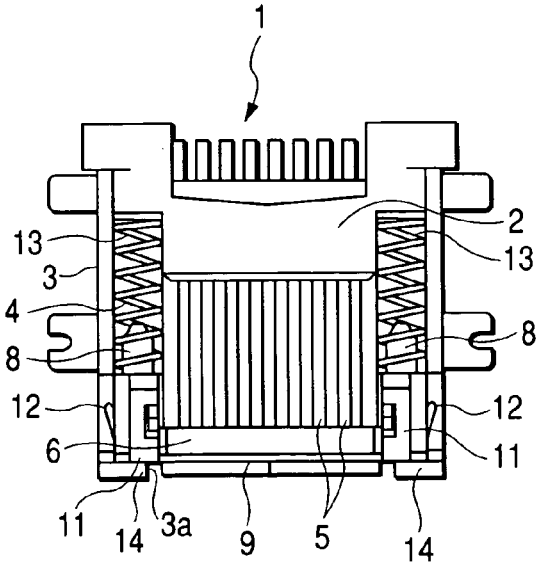
FIG. 6A is a plan view of the connector, showing a condition before the cover is slid.

A coil spring 13 is mounted between a right side portion of the connector body 2 and the right spring supporter 8 of the cover 6, while another coil spring 13 is mounted between a left side portion of the connector body 2 and the left spring supporter 8 as shown in FIGS. 5 and 6A. As a result, the cover 6 is urged forward by the coil springs 13, and is stopped by stoppers 14 formed respectively at right and left end portions of a lower edge portion of an opening 3*a* in the shield case 3 so as to extend upward.

Figure 6B:
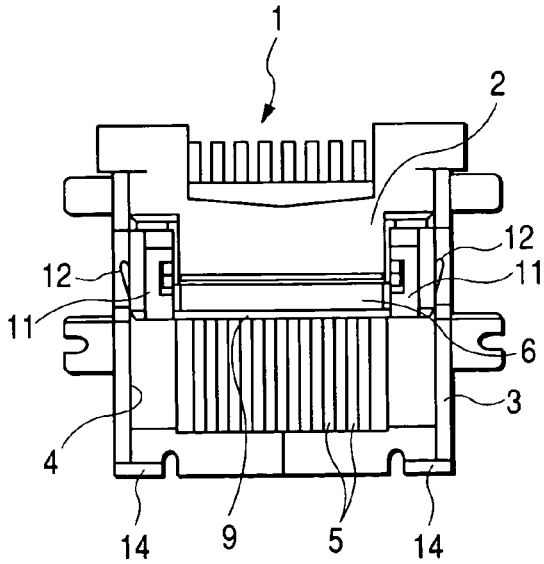
FIG. 6B is a plan view of the connector, showing a condition after the cover is slid.

When the cover 6, having the metal shield 9 attached thereto, is pushed rearward by the mating plug, the metal shield 9 and the cover 6 are moved toward the rear end of the fitting hole 4, and is stopped at a predetermined position shown in FIG. 6B. At this time, the front portions of the contacts 5 pass through the through hole 7 of the cover 6 and the through hole 10 of the metal shield 9, and are exposed at the front part of the connector 1 to be connected respectively to contacts of the mating plug.

Incidentally, the contact pieces 12 of the metal shield 9 are always held in contact with the shield case 3, and is electrically connected thereto. When static electricity develops in the metal shield 9 upon contact of the mating plug or other object with the metal shield 9, this static electricity is caused to escape to the shield case 3, thereby preventing damage of the contacts 5.

With the above configurations, the cover 6 prevents dust from flowing into the connector, and besides the metal shield 9 prevents electrostatic damage of the contacts 5.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, comprising:

a conductive shield case;

an insulative connector body, accommodated in the shield case;

a conductive contact, provided on the connector body;

an insulative cover, accommodated in the shield case so as to be slidable between a first position for concealing the contact and a second position for exposing a part of the contact and allowing a mating connector to electrically contact therewith; and a conductive shield member, attached onto a front face of the cover which faces the mating connector, wherein the cover comprises a first engagement member, and the shield member comprises a second engagement member engaged with the first engagement member, wherein the shield member comprises a conductive piece which is always brought into contact with the shield case.

2. The connector according to claim 1, wherein the cover is slidably provided in a fitting hole of the connector body.

3. The connector according to claim 1, wherein the connector is for charging a magneto-optic storage device or a video camera.

4. A connector, comprising:

a conductive shield case;

an insulative connector body, accommodated in the shield case;

a conductive contact, provided on the connector body;

an insulative cover, accommodated in the shield case so as to be slidable between a first position for concealing the contact and a second position for exposing a part of the contact and allowing a mating connector to electrically contact therewith; and a conductive shield member, attached onto a front face of the cover which faces the mating connector, wherein the cover comprises a first engagement member, and the shield member comprises a second engagement member engaged with the first engagement member, wherein the cover includes a first through hole through which the contact is passed so that a part of said contact is exposed when said cover is at said second position, and wherein the conductive shield member includes a second through hole through which the contact is passed so that said part of said contact is exposed when said cover is at said second position.

5. A connector, comprising:

a conductive shield case;

a stationary insulative connector body accommodated in the shield case, said stationary insulative connector body having a protruding portion;

conductive contacts which extend along opposite sides of said protruding portion of said stationary insulative connector body and which terminate at an end of said protruding portion;

a moveable insulative cover accommodated in the shield case which is slidable between a first position for concealing the conductive contacts and a second position for exposing at least a portion of the conductive contacts allowing a mating connector to electrically contact therewith, said moveable insulative cover having an opening which allows said protruding portion of said stationary insulative connector body to extend therethrough when said moveable insulative cover is in said second position; and a conductive shield member attached onto a front face of the cover which faces the mating connector.

6. The connector of claim 5 wherein said moveable insulative cover and said conductive shield member each have engagement members which are joined together for attaching said conductive shield to said moveable insulative cover.

* * * * *